US012163340B1

(12) United States Patent
Heidebrink

(10) Patent No.: US 12,163,340 B1
(45) Date of Patent: Dec. 10, 2024

(54) 3D NOTCH TROWEL

(71) Applicant: Steven Glenn Heidebrink, Santa Rosa, CA (US)

(72) Inventor: Steven Glenn Heidebrink, Santa Rosa, CA (US)

( * ) Notice: Subject to any disclaimer, the term of this patent is extended or adjusted under 35 U.S.C. 154(b) by 0 days.

(21) Appl. No.: 18/227,822

(22) Filed: Jul. 28, 2023

(51) Int. Cl.
*E04F 21/16* (2006.01)

(52) U.S. Cl.
CPC ..... *E04F 21/162* (2013.01)

(58) Field of Classification Search
CPC ..... E04F 21/161–163
USPC ..... 15/235.4
See application file for complete search history.

(56) References Cited

U.S. PATENT DOCUMENTS

| | | | | |
|---|---|---|---|---|
| 2,626,520 | A * | 1/1953 | Whalen | E04F 21/04 15/235.5 |
| 5,231,729 | A | 8/1993 | Rose | |
| 6,205,610 | B1 | 3/2001 | Westthorp | |
| 7,263,740 | B2 | 10/2007 | Crisswell | |
| 7,370,384 | B2 | 5/2008 | Miller et al. | |
| 7,493,671 | B2 | 2/2009 | Gonzalez et al. | |
| 7,784,143 | B1 | 8/2010 | Murray | |
| 2009/0217476 | A1 | 10/2009 | Gonzalez et al. | |
| 2010/0107352 | A1 | 5/2010 | Serino et al. | |
| 2014/0115804 | A1 * | 5/2014 | Propst | E04F 21/162 15/235.4 |
| 2021/0277672 | A1 | 9/2021 | Uulu et al. | |
| 2022/0364374 | A1 | 11/2022 | Lacasse-Veilleux et al. | |

FOREIGN PATENT DOCUMENTS

| | | | | |
|---|---|---|---|---|
| DE | 202009004665 | U1 * | 7/2009 | E04F 21/06 |
| GB | 9010144 | | 6/1990 | |
| JP | 2023021668 | A | 2/2023 | |
| WO | WO-2007146635 | A1 * | 12/2007 | B05C 17/10 |
| WO | 2008035095 | | 3/2008 | |

OTHER PUBLICATIONS

Translation of DE202009004665U1 (Year: 2009).*

* cited by examiner

*Primary Examiner* — Tom Rodgers
(74) *Attorney, Agent, or Firm* — My Patent Guys; Christopher Pilling

(57) ABSTRACT

The present invention provides an improved 3D notch trowel designed for the application of materials such as adhesive. The trowel features a blade with at least one notched edge, having a 3D profile, which can take various forms including a round, as well as square, rectangular, triangular, or similar shapes. This notched edge comprises a top portion and a bottom portion that define an opening, a depth, and a perimeter surface having an angle. This unique design allows for the creation of consistent and evenly distributed grooves in the adhesive material at various angles relative to the flooring surface. Additionally, the notched edge of the trowel is capable of being filed down multiple times while maintaining the same consistency of material application. This design enhances the longevity of the trowel.

5 Claims, 7 Drawing Sheets

104B

104C

104D

104A

3D NOTCH TROWEL

CROSS-REFERENCE TO RELATED APPLICATIONS

N/A

BACKGROUND OF THE INVENTION

1. Field of the Invention

The present invention relates to trowels but more particularly a 3D (three dimensional) notch trowel for applying adhesive.

2. Description of Related Art

In construction and carpet and vinyl work, or similar it is common to use a trowel to apply a layer of adhesive onto a surface before affixing the flooring material. The process involves spreading a layer of adhesive material and creating grooves in the material using the notched edge of the trowel. The grooves help control the amount of adhesive material that remains on the surface.

Traditional 3D notch trowels are typically designed with square or V-shaped notches along the edge. The size and spacing of these notches determine the depth and width of the grooves in the adhesive, which in turn controls the thickness of the adhesive layer. However, these conventional trowel designs may not always provide a consistent thickness of the adhesive layer, leading to problems when the flooring material is installed.

Furthermore, conventional trowels may require significant manual adjustment and skill from the user to achieve a consistent adhesive. This can lead to inconsistent results, especially in the hands of less experienced users. These issues can result in longer work times, increased material waste, and lower quality final products.

Thus, there is a need for an improved 3D notch trowel that can reliably and consistently apply a controlled thickness of adhesive, regardless of the user's level of experience. It would be advantageous if such a tool could improve the efficiency of the flooring process, reduce material waste, and enhance the quality of the final flooring work. Consequently, a solution is provided.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a 3D notch trowel, is provided, comprising a blade having at least a first notched edge and a second notched edge; a handle configured to be gripped by a user; a shank connecting the handle to the blade; and, wherein the first notched edge has a 3D profile, the first notched edge comprising a top portion and a bottom portion, the top portion and the bottom portion defining an opening, a depth, and a perimeter surface having an angle.

In one embodiment, the 3D profile is round, rectangular, or triangular. In another embodiment, the angle is approximately 45 degrees. In another embodiment, the first notched edge is configured to create consistent and evenly distributed grooves in adhesive at various angles in relation to a flooring surface. In one embodiment, the first notched edge is capable of being filed down multiple times while maintaining the same 3D profile and depth. In one embodiment, the second notched edge has a 3D profile. In another embodiment, the second notched edge has a 2D profile.

The foregoing has outlined rather broadly the more pertinent and important features of the present disclosure so that the detailed description of the invention that follows may be better understood and so that the present contribution to the art can be more fully appreciated. Additional features of the invention, which will be described hereinafter, form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE DRAWINGS

Other features and advantages of the present invention will become apparent when the following detailed description is read in conjunction with the accompanying drawings, in which.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an improved 3D notch trowel.

It is to be understood that the terminology used herein is for the purpose of describing particular embodiments only and is not intended to be limiting. The terms "a" or "an," as used herein, are defined as to mean "at least one." The term "plurality," as used herein, is defined as two or more. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time. These terms generally refer to a range of numbers that one of skill in the art would consider equivalent to the recited values (i.e., having the same function or result). In many instances these terms may include numbers that are rounded to the nearest significant figure. The term "flooring" may include any surface that an adhesive is intended to be applied to, e.g. floor, wall, or ceiling. The term "3D" represents an edge of the trowel having depth, and specially a greater depth than the depth of the blade.

Figure 1:
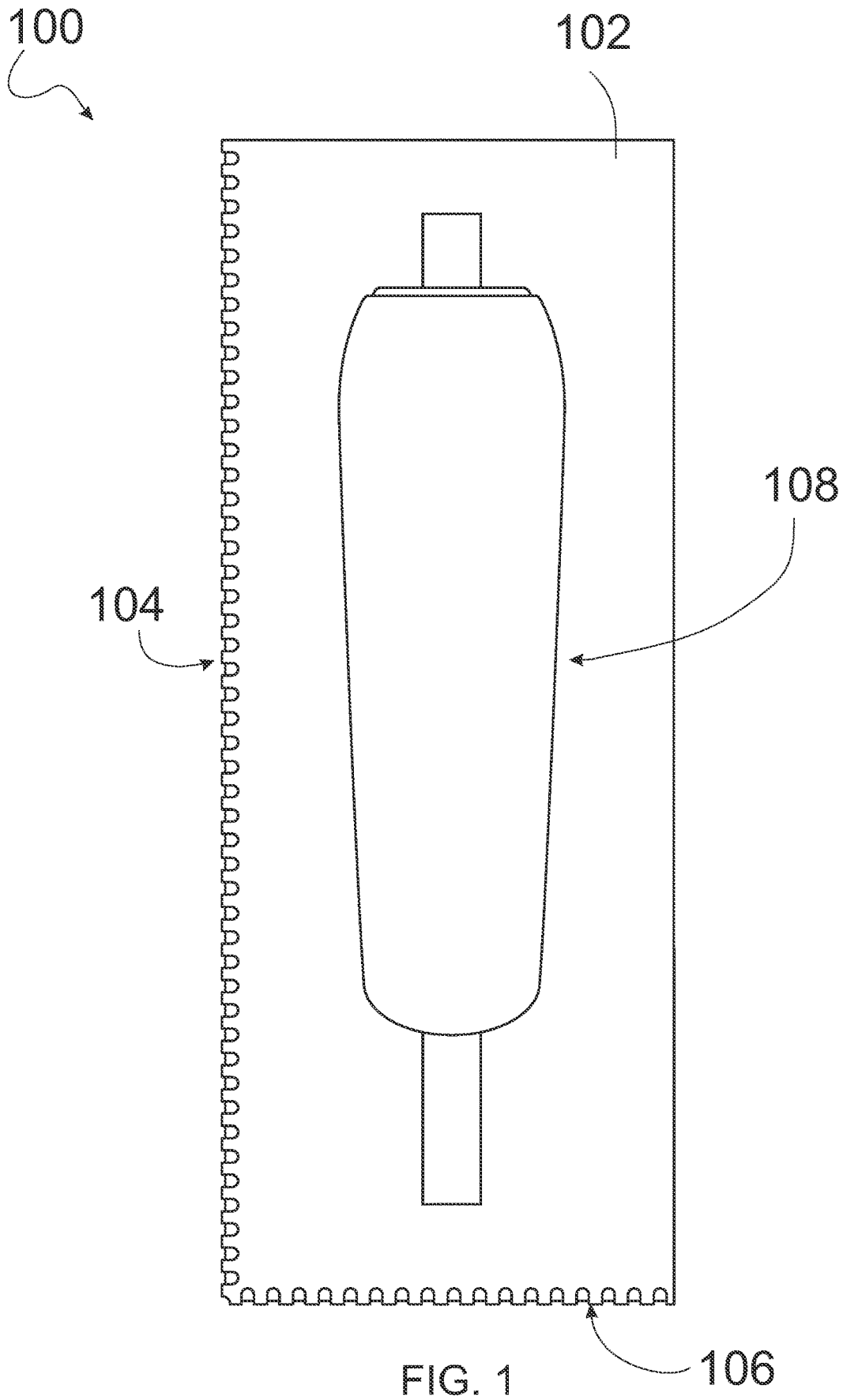
FIG. 1 is a top view of the 3D notch trowel according to an embodiment of the present invention.
Figure 2A:
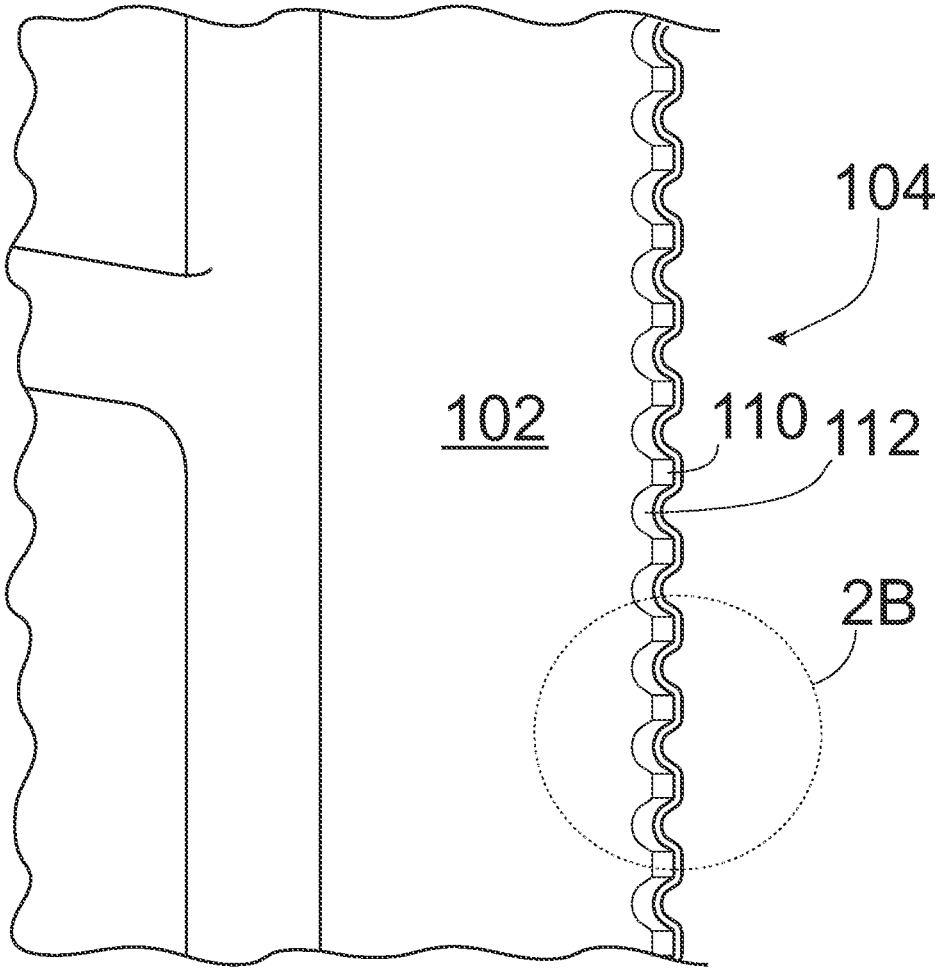
FIG. 2A is a detailed top right perspective view of the trowel according to an embodiment of the present invention.
Figure 2B:
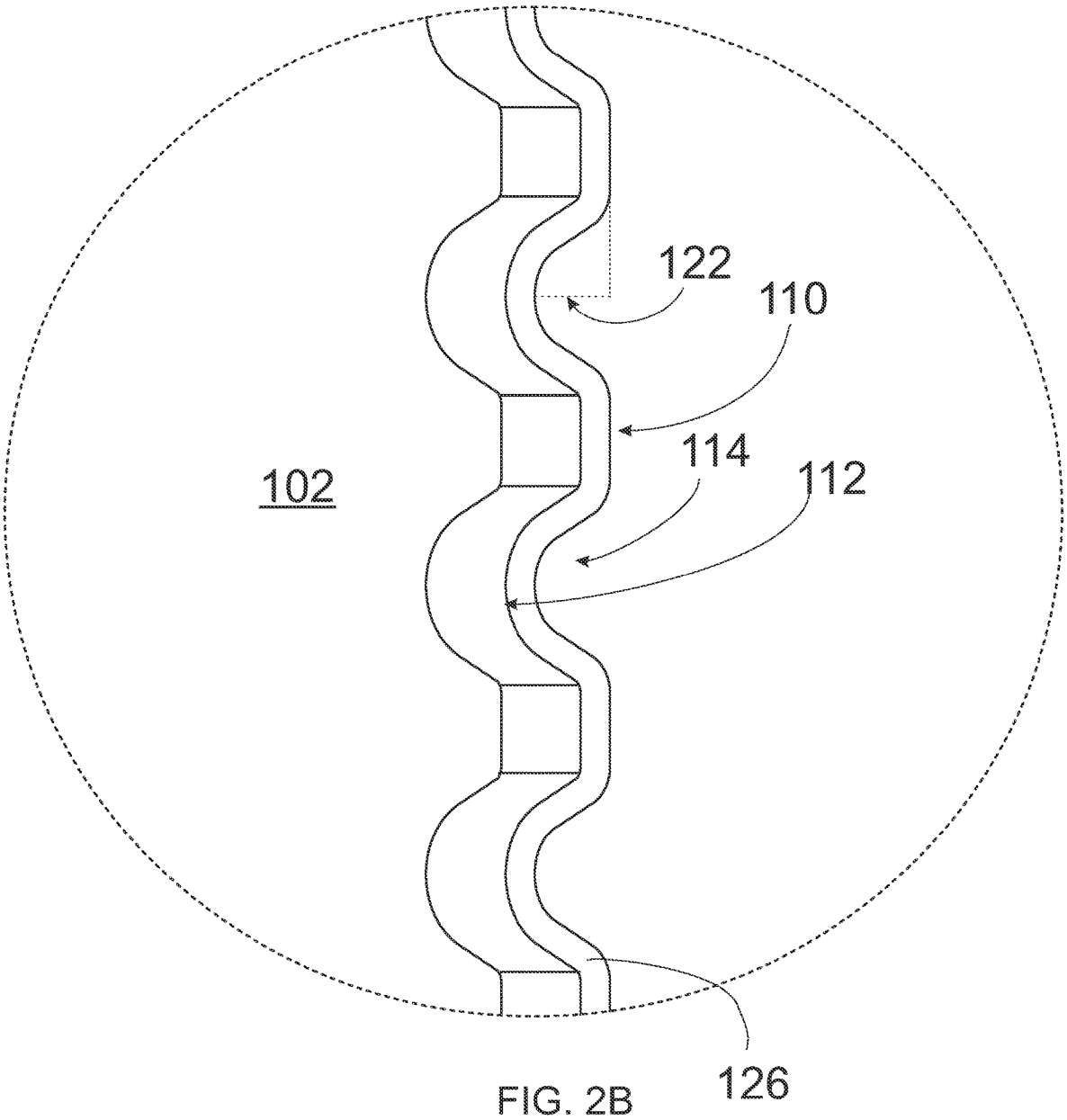
FIG. 2B is a detailed view of detail 2B of FIG. 2A.
Figure 3:
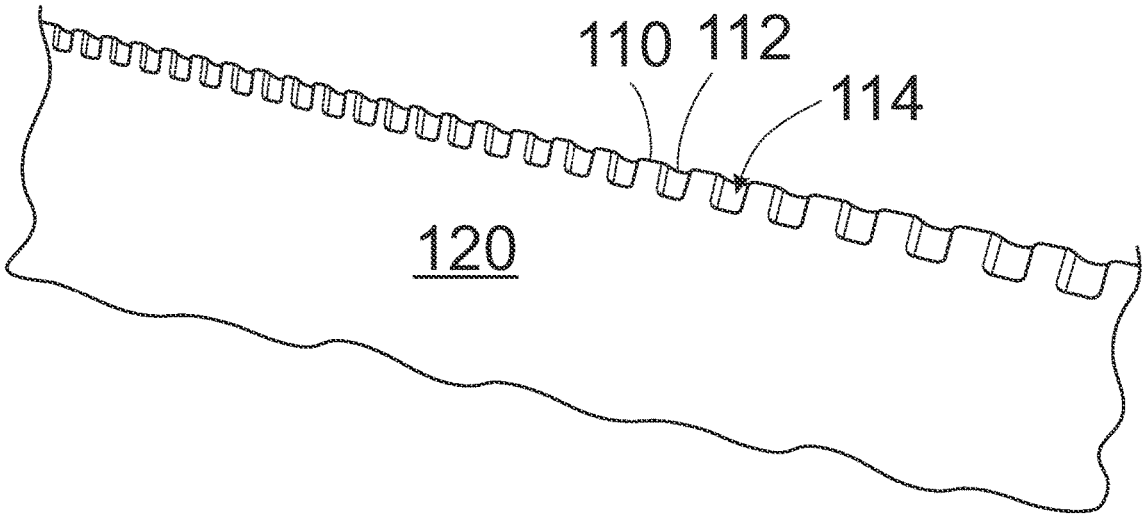
FIG. 3 is a detailed bottom right perspective view of the trowel according to an embodiment of the present invention.

FIG. 1 is a top view of the improved 3D notch trowel according to an embodiment of the present invention. Referring now to FIG. 1, the improved 3D notch trowel 100 is illustrated. In one embodiment, the trowel 100 comprises a blade 102, a first notched edge 104, a second notched edge 106, a pair of flat edges 108, a shank 116, and handle 118. For the purposes of this disclosure the first and second notched edges 104 and 106 define the inventive features of the invention. The other features of the invention are typical components found in notch trowels and their details are considered outside the scope of the present invention, however these components are necessary for use. The following provides a general description, but it should be understood that these components may vary as well known in the art. The handle 118 enables a user to grip the trowel 100 during use. It is shaped and designed to be ergonomic and comfortable for extended use. In some embodiments, the handle 118 is typically made of a durable and non-slip material such as plastic, leather, rubber, or wood. The shank 116 is configured to connect the handle 118 to the blade 102. The shape or curve of the shank 116 may vary, as is well known in the art. In one embodiment, the blade 102 is flat, and rectangular in shape and comprises the notched and flat edges. It should be understood that although the illustrated embodiment depicts a pair of adjacent notched edges and a pair of adjacent flat edges, the number and location of the edges may vary. Further, as previously discussed, the structure of the notched edges defines the inventive feature of the present invention, however the illustrated structure of the first notched edge 104 the second notched edge 106 is just an exemplary embodiment of one variation of the present invention. As is well known in the art, typical notched edges have a V-shape or square profile with no depth in relation to the blade, which may be referred to as a 2D profile. In some embodiments, a typical notch construction (2D profile) may be provided on the second notched edge 106 rather than the inventive notched edge.

Figure 4A:
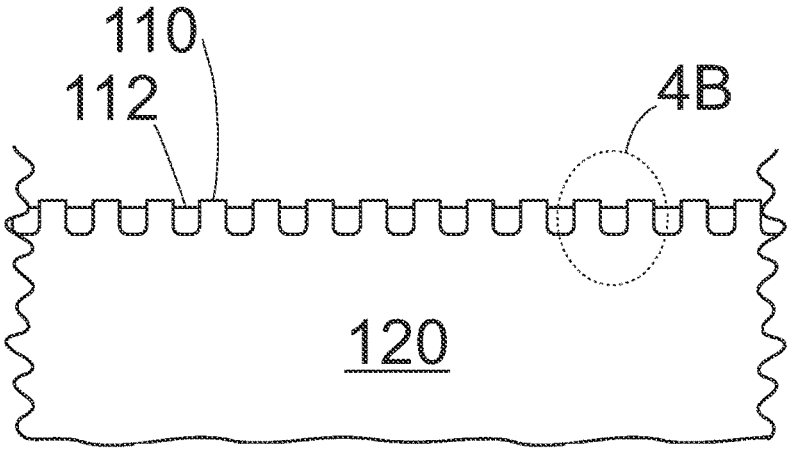
FIG. 4A is a detailed bottom view of the trowel according to an embodiment of the present invention.
Figure 4B:
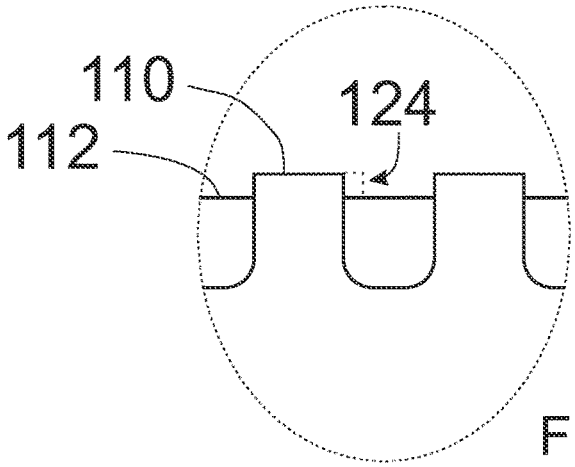
FIG. 4B is an enlarged detailed view of detail 4B of FIG. 4A.

Referring now to FIGS. 2A-4B, various detailed views of the trowel 100 are illustrated. In some embodiments, the first notched edge 104 comprises a top portion 112 and a bottom portion 110, with the top portion 112 forming an opening 114. The distance between the top portion 112 and the bottom portion 110 defines a depth 122. In one embodiment, the depth is approximately 2 mm. In some embodiments, the depth is between 1-2 mm. Yet in other embodiments, the depth is 2-15 mm. However, it is understood that the depth may vary depending on the desired consistency of the adhesive during use. Further, as best seen in FIG. 4B when viewing the trowel from the bottom surface 120, a distance 124 is provided. This distance, defined by the space between the edge of the top portion 112 and the edge of the bottom portion 110, creates an angle on the notched edge perimeter surface 126 (best seen in FIG. 2B). In some embodiments, the angle is approximately 45 degrees. However, it should be understood that the angle may vary.

Figure 5:
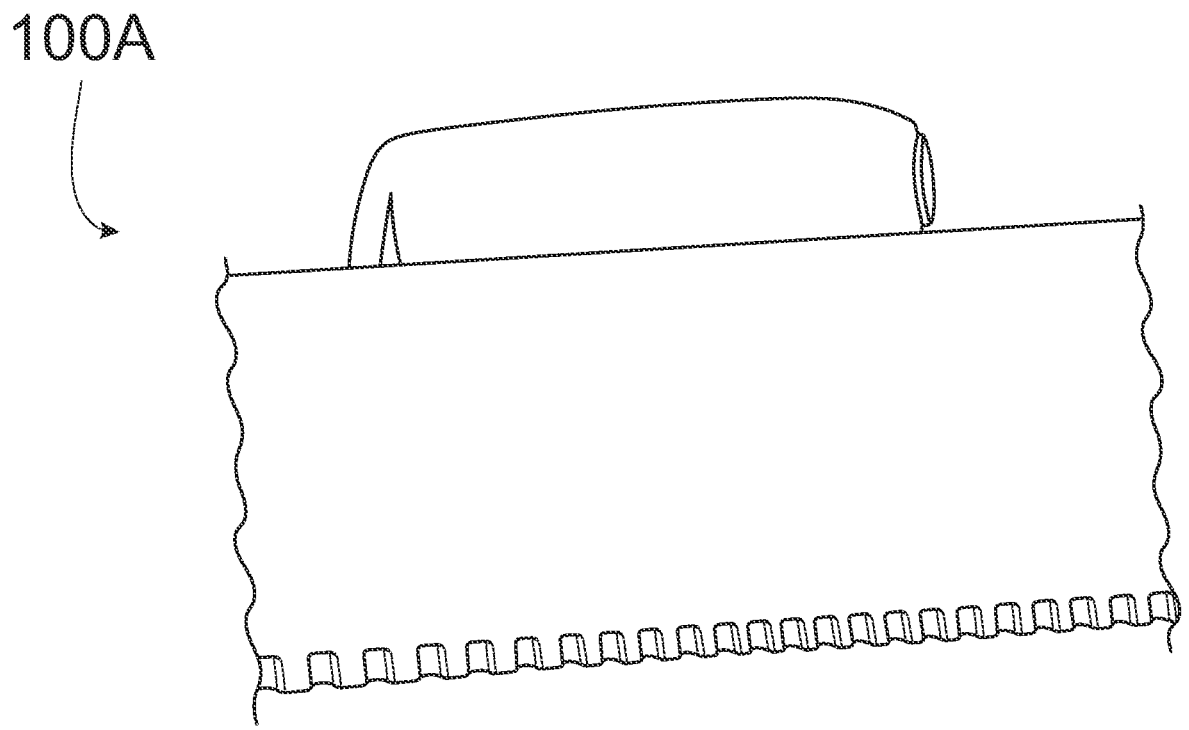
FIG. 5 is a detailed perspective view of the trowel at an approximately vertical orientation such that the bottom surface of the trowel is approximately perpendicular to the flooring surface according to an embodiment of the present invention.
Figure 6:
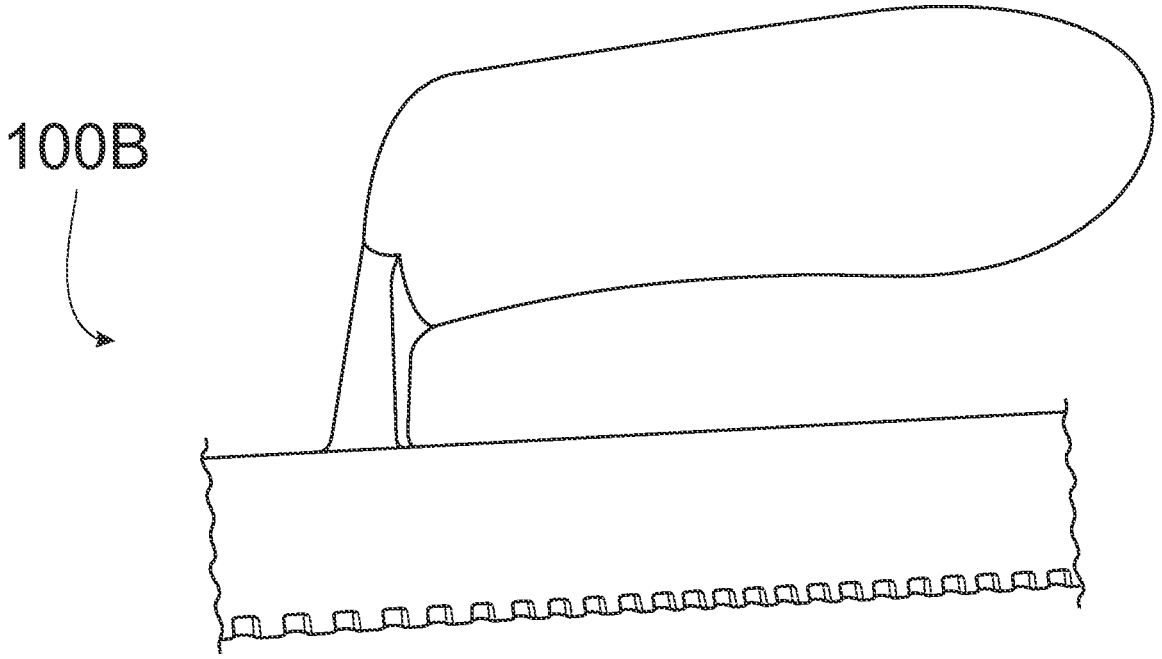
FIG. 6 is a detailed perspective view of the trowel at an approximately 45 degrees of orientation in relation to the flooring surface according to an embodiment of the present invention.

Also now, referring to FIGS. 5-6, various views of the trowel at different degrees of orientation (100A and 100B) in relation to a flooring surface are illustrated. Advantageously, the inventive notched edge shape of the present invention serves to create consistent and evenly distributed grooves in the adhesive at various angles (degrees of orientation) in relation to the flooring surface, this is particularly due to the depth and angle provided by the notched edge. Further, the inventive notched edge enables the trowel to deliver a uniform thickness of adhesive material across the surface, contributing to improved adhesion and a higher quality of finished flooring work, especially when utilized by users of varying skill levels.

Figure 7A:
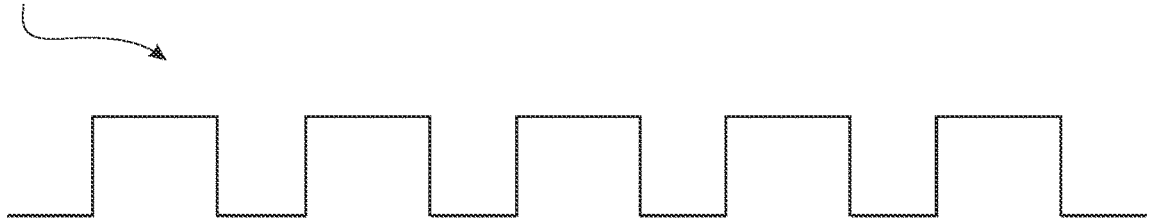
FIG. 7A is a front view of a rectangular shape profile of the first notched edge according to an embodiment of the present invention.
Figure 7B:
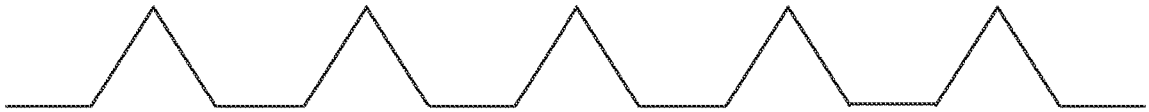
FIG. 7B is a front view of a triangular shape profile of the first notched edge according to an embodiment of the present invention.
Figure 7C:
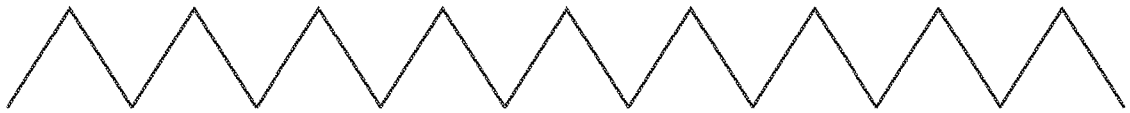
FIG. 7C is a front view of a second triangular shape profile of the first notched edge according to an embodiment of the present invention.
Figure 7D:
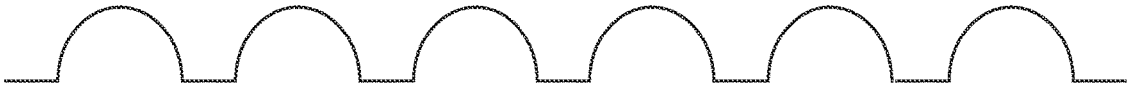
FIG. 7D is a front view of a round shape profile of the first notched edge according to an embodiment of the present invention.
Figure 7E:
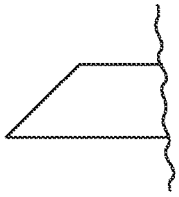
FIG. 7E is a side provide of the first notched edge according to an embodiment of the present invention.

In the depicted embodiment of the invention, the notched edge of the trowel features a round shape, providing a specific depth, angle, and opening as illustrated. However, while the round represents one specific implementation of this inventive concept, it's essential to underscore that the shape of the grooves on the notched edge could take various forms. Simply put, the invention is not limited to a round profile. Referring now to FIGS. 7A-D, the 3D notched grooves could be shaped rectangular 104A (or square), triangular 105B, triangular with reduced spacing 105C (minimized bottom portion), circular or round 104D as previously discussed, among other shapes, as long as these shapes have the same characteristics as the illustrated shapes, specifically having an upper and lower portion defining a depth, angle, and opening. It should be noted that any of the various profile shapes may include a varied bottom portion width, such that the space between groove shapes may vary. FIG. 7E shows the profile from the side showing the approximate 45 degree angle of the perimeter surface.

Another advantage of the present invention is the extended life cycle of the trowel compared to traditional trowels of the prior art. As is well known in the field, frequent use of trowels can cause their edges to become uneven or damaged, affecting the spread of materials such as adhesive. Typically, this issue necessitates the user filing down the edge of the trowel with a rod file. However, due to the flat shape of a typical trowel edge, this process yields varying results and may result in the trowel having more uneven groove structures within its notches. After filing, the size of the grooves are reduced.

The present invention, with its angled perimeter edge on the notched side, allows a user to easily and more intuitively file down the angled edge to restore the profile of the notched edge using a flat file. Further, due to the unique profile and structure of the notched edge, the trowel of the present invention may be filed down more times than a typical trowel and still maintain the same consistency of material application. This is attributed to the fact that when filing a traditional trowel, its notches are reduced in size with each filing. Eventually, this reduction renders the trowel unusable. In contrast, the present invention's design ensures that its functional performance remains consistent, even with repeated filing, thus prolonging the usability of the trowel. In some embodiments, the 3D profile may extend to increase the life cycle of the trowel. Further, filing the 3D profile of the present invention ensures the notched edge is of the same specifications as originally provided, which can't be said for the trowels of the prior art.

The extended life cycle of the trowel proposed in this invention offers several significant benefits. First, it can lead to substantial cost savings for the user. By allowing for repeated filing and restoration of the trowel's edge, users can maintain the tool's functionality over a longer period, reducing the need for frequent replacements and the associated expenses. Second, this longevity contributes to time efficiency. Minimizing the time spent on sourcing and purchasing new trowels, users can maintain an uninterrupted workflow, enhancing overall productivity. Third, the design of this trowel is user-friendly and intuitive, making it an accessible tool for users of all skill levels. Lastly, the ability of this trowel to maintain a consistent application of material, even after multiple filings, underscores its versatility. This makes it a reliable and adaptable tool for a wide range of projects and conditions over time.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. In other words, the terminology and phraseology used in this description and the abstract are for illustrative purposes and should not be considered limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, references to "first," "second," "third," and so fourth members throughout the disclosure (and in particular, claims) are not used to show a serial or numerical limitation but instead are used to distinguish or identify the various members of the group.

What is claimed is:

1. A 3D notch trowel comprising:

a blade having at least a first notched edge and a second notched edge;

a handle configured to be gripped by a user;

a shank connecting the handle to the blade; and, wherein the first notched edge has a 3D profile, the first notched edge comprising a top portion and a bottom portion, the top portion having a top edge and the bottom portion having a bottom edge defining an opening and a vertical distance between the top edge and the bottom edge defining a depth, wherein the depth is consistent throughout the blade, and a horizontal distance between the top edge and the bottom edge creating an angle approximately 45 degrees, wherein the angle defines a consistent perimeter surface having a rectangular shape, wherein one of the notched edges is capable of being filed down multiple times while maintaining the same 3D profile and depth.

2. The 3D notch trowel of claim 1, wherein the 3D profile is round.

3. The 3D notch trowel of claim 1, wherein the first notched edge is configured to create consistent and evenly distributed grooves in adhesive at various angles in relation to a flooring surface.

4. The 3D notch trowel of claim 1, wherein the second notched edge has a 3D profile.

5. The 3D notch trowel of claim 1, wherein the second notched edge has a 2D profile.

* * * * *